US010744367B2

(12) United States Patent
Kim

(10) Patent No.: US 10,744,367 B2
(45) Date of Patent: Aug. 18, 2020

(54) BED WITH EXERCISE FUNCTION

(71) Applicant: Wan Yong Kim, Incheon (KR)

(72) Inventor: Wan Yong Kim, Incheon (KR)

(73) Assignee: Wan Yong Kim, Incheon (KR)

( * ) Notice: Subject to any disclaimer, the term of this patent is extended or adjusted under 35 U.S.C. 154(b) by 83 days.

(21) Appl. No.: 16/082,277

(22) PCT Filed: Feb. 22, 2017

(86) PCT No.: PCT/KR2017/001916
§ 371 (c)(1),
(2) Date: Sep. 5, 2018

(87) PCT Pub. No.: WO2017/155228
PCT Pub. Date: Sep. 14, 2017

(65) Prior Publication Data

US 2019/0091509 A1 Mar. 28, 2019

(30) Foreign Application Priority Data

Mar. 6, 2016 (KR) ..... 10-2016-0026756

(51) Int. Cl.

| | |
|---|---|
| ***A63B 21/16*** | (2006.01) |
| ***A63B 23/02*** | (2006.01) |
| ***A63B 23/035*** | (2006.01) |
| ***A47C 19/22*** | (2006.01) |
| ***A47C 19/02*** | (2006.01) |
| ***A47C 31/00*** | (2006.01) |

(Continued)

(52) U.S. Cl.
CPC ..... *A63B 21/1672* (2015.10); *A47C 19/022* (2013.01); *A47C 19/22* (2013.01);
(Continued)

(58) Field of Classification Search
CPC . A63B 21/04; A63B 21/0421; A63B 21/0435; A63B 21/0442; A63B 21/00047;
(Continued)

(56) References Cited

U.S. PATENT DOCUMENTS 541,339 A * 6/1895 Thompson ..... A47C 21/02 5/504.1
543,577 A * 7/1895 Guilford ..... A47C 21/02 5/504.1

(Continued)

FOREIGN PATENT DOCUMENTS

KR 20-2000-0018518 U 10/2000
KR 20-0323500 Y1 8/2003

(Continued)

OTHER PUBLICATIONS

Shop Bedding, Ashton Detachable Bed Skirt [online], published Jun. 2, 2014, [retrieved on Jan. 6, 2020]. Retrieved from the Internet <URL: https://www.youtube.com/watch?v=mjhj8U355gQ&feature=emb_title> (Ashton). (Year: 2014).*

(Continued)

*Primary Examiner* — Loan B Jimenez
*Assistant Examiner* — Zachary T Moore

(57) ABSTRACT

A bed with an exercise function includes: an upper exercise arm which is embedded in an insertion groove formed in a front surface or peripheral part of the head part, has a horizontal bar and leg parts extending downward from both ends of the horizontal bar, and is rotatable to protrude forward by a rotary support part provided at a lower end of the leg part; and a rotation stopping part which is coupled to the upper exercise arm and stops rotation of the upper exercise arm in a state in which the upper exercise arm protrudes forward at a predetermined angle.

5 Claims, 8 Drawing Sheets

(51) Int. Cl.
*A63B 21/072* (2006.01)
*A63B 71/06* (2006.01)
*A63B 21/00* (2006.01)

(52) U.S. Cl.
CPC ..... *A47C 31/00* (2013.01); *A63B 21/00* (2013.01); *A63B 21/4027* (2015.10); *A63B 23/02* (2013.01); *A63B 23/035* (2013.01); *A63B 71/06* (2013.01); *A63B 21/0724* (2013.01); *A63B 23/03516* (2013.01)

(58) Field of Classification Search
CPC . A63B 21/40; A63B 21/4027; A63B 21/4029; A63B 21/4033; A63B 21/4035; A63B 23/00; A63B 23/035; A63B 23/03516; A63B 23/03525; A63B 23/0355; A63B 23/03558; A63B 23/12; A63B 2210/00; A63B 2210/04; A63B 2210/50; A61G 7/05; A61G 7/0506; A47C 19/021; A47C 19/022
USPC ..... 5/424–430, 488, 53.1
See application file for complete search history.

(56) References Cited

U.S. PATENT DOCUMENTS 557,796 A * 4/1896 Freeman ..... A47C 21/02 5/504.1
2,959,414 A * 11/1960 Saltz ..... A63B 21/4043 482/127
3,048,857 A * 8/1962 Hutt ..... A61G 7/051 5/429
3,218,067 A * 11/1965 Beverly ..... A63B 22/0076 482/133
3,351,960 A * 11/1967 Burkholder ..... A47C 19/022 5/635
6,374,437 B1 * 4/2002 Voelker ..... A61G 7/0507 5/425
6,795,988 B2 * 9/2004 Hueppe ..... A61G 7/05 5/424
8,528,133 B2 * 9/2013 Van Houte ..... A47C 21/028 5/482
8,793,823 B2 * 8/2014 Baugh ..... A47C 19/022 5/280
9,687,401 B2 * 6/2017 Alford ..... A61G 7/05
2015/0165256 A1 * 6/2015 Salamon ..... A63B 23/1281 482/129

FOREIGN PATENT DOCUMENTS

KR 20-2010-0011633 U 12/2010
KR 20-2013-0002864 U 5/2013

OTHER PUBLICATIONS

International Search Report for PCT/KR2017/001916 dated May 12, 2017 from Korean Intellectual Property Office.

* cited by examiner

BED WITH EXERCISE FUNCTION

TECHNICAL FIELD

The present invention relates to a bed with an exercise function, and more specifically, to a bed with an exercise function having a new structure in which exercise apparatuses embedded in a bed body protrude such that a user easily exercises before and after sleeping, and which is good for health of the user.

BACKGROUND ART

Beds are general goods for sleeping or resting in a comfortable state, and are mainly designed in consideration of a functionality of sleeping and resting, and an aesthetic design as interior furniture. Meanwhile, an ordinary bed in which a flat mattress is installed may cause pain in a back or other parts in a case in which a user uses the bed for a long time period. Particularly, in the case of patients with a physical disability affecting a body part such as an arm or leg or the elderly who stay in bed for a long time period, health of the user is not good due to lack of exercise. This kind of problem also occurs in ordinary persons who are busy and tired so that it is difficult to secure time to exercise.

In consideration of such a problem, a bed in which exercise apparatuses are provided in a conventional bed, a user who is in the bed or under recuperation or treatment can exercise with the exercise apparatuses included in the bed before and after sleeping without departing from the bed has been known. However, in such a conventional bed, since the exercise apparatuses mostly protrude and are exposed at an outside of the bed, in a case in which the bed has to be used for an original purpose of a bed such as sleeping or resting without exercising, there are problems in that the exercise apparatuses may be a cumbersome obstacle and an exterior design may not be good. Accordingly, the bed having the exercise apparatuses does not have a specific problem when applied as a bed of a medical institution or sports center having a main purpose of medical rehabilitation, recuperation, or exercising, but is unsuitable to be applied to a bedroom installed in a house, hotel, or condominium in which the original function of bed such as sleeping or resting or an exterior design is more important.

DISCLOSURE

Technical Problem

The present invention is directed to providing to a bed with an exercise function having a new structure which is inserted into and installed in a main body of the bed, is not normally noticeable or cumbersome when climbing into bed, and is easily manually or automatically withdrawn from the bed as necessary such that a user easily exercises just before sleeping or right after waking up without departing from the bed during recuperation or resting, and thus an exercise effect such as muscle strengthening and blood circulation is achieved.

Technical Solution

One aspect of the present invention provides a bed with an exercise function (1) which includes a main frame (4) formed with an upper surface (5) on which a mattress (8) and bed linen are placed, and a head part (6) which stands upright at one end of the main frame (4), wherein the bed with an exercise function (1) includes an upper exercise arm (14) which is embedded in an insertion groove (12) formed in a front surface or peripheral part of the head part (6), has a horizontal bar (15) and leg parts (16) extending downward from both ends of the horizontal bar (15), and is rotatable to protrude forward by a rotary support part (18) provided at a lower end of the leg part (16), and a rotation stopping part (19) which is coupled to the upper exercise arm (14) and stops rotation of the upper exercise arm (14) in a state in which the upper exercise arm (14) protrudes forward at a predetermined angle.

Another aspect of the present invention provides the bed with an exercise function (1) further including lower exercise arms (20, 21) which are embedded in insertion grooves (22, 23) formed along a peripheral part of the upper surface (5) which is at a leg side of the bed with an exercise function (1) that faces the head part (6) of the main frame (4), have horizontal bars (24, 25) and leg parts (26, 27) perpendicularly extending from both ends of the horizontal bars (24, 25), and are rotatable to protrude upward by rotary support parts 28 provided at both ends of the leg parts (26, 27).

Still another aspect of the present invention provides the bed with an exercise function (1) in which at least one of the lower exercise arms (20, 21) is constituted as a pair of divided horizontal bars (24*a*) into which the horizontal bar (24) is laterally divided, and an elastic support unit 29 is provided at each of the leg parts (26) of the divided horizontal bars (24*a*) and are individually and elastically rotatable by an external force.

Yet another aspect of the present invention provides the bed with an exercise function (1) in which peripheral part covers (32, 34) are provided at the peripheral part of the upper surface (5) of the main frame (4) and configured to openably cover the insertion grooves (22, 23) for the lower exercise arms (20, 21).

Advantageous Effects

According to the present invention, by providing an upper exercise arm (14) capable of protruding forward by providing a horizontal bar (15), leg parts (16), a rotary support part (18), and a rotation stopping part (19) so as to be embedded in an insertion groove (12) formed in a front surface or peripheral part of a head part (6) of a bed with an exercise function (1) having a main frame (4) and a head part (5), since the upper exercise arm (14) is normally accommodated in the insertion groove (16) of the head part (6) of the bed with an exercise function (1) and not exposed to the outside, the upper exercise arm (14) is not hooked on or does not interfere with climbing into bed to sleep or take a rest, is not an eyesore, does not hinder an original function of a bed such as sleeping or resting or design aspects of a bed, and when necessary, by rotating the upper exercise arm (14) to protrude over a head at a predetermined angle, a user can stretch an arm to grip the upper exercise arm (14) with hands, can conveniently perform an exercise to lift an upper body without needing a separate time or departing to a different place for exercising in a state in which the user lies down on the bed just before sleeping or right after waking up, and can try to improve health.

In addition, by providing lower exercise arms (20, 21) which are rotatable to protrude upward by including horizontal bars (24, 25), leg parts (26, 27) extending from both ends of the horizontal bars (24, 25), and a rotary support part (28) configured to support lower ends of the leg parts (26, 27), and are embedded in insertion grooves (22, 23) formed along an edge part of the upper surface (5) which is at a leg side that faces the head part (5) of the main frame (4), the user can rotate the lower exercise arms (20, 21) upward and stop the lower exercise arms (20, 21) vertically to perform a leg exercise while pushing the lower exercise arms (20, 21) with feet, or a sit-up while hooking the feet on the lower exercise arms (20, 21), or perform an exercise such as a pushup while turning over in the bed and gripping the lower exercise arms (20, 21), and thus the bed with an exercise function (1) is convenient.

In addition, by laterally dividing at least one of the lower exercise arms (20, 21) such that the horizontal bar (24) is constituted as a pair of divided horizontal bars (24*a*), into which the horizontal bar (24) is laterally divided, and providing separate elastic support units (29) at the leg parts (26) of the divided horizontal bars (24*a*), in the case of the bed such as a double bed used by a couple, the man and woman who have different exercise abilities can perform exercises individually while pushing the divided horizontal bars (24*a*) with feet or pushing or pulling the divided horizontal bars (24*a*) with hands, the couple can use the bed according to the individual exercise abilities, and thus the bed with an exercise function (1) is convenient.

In addition, according to the present invention, since the bed with an exercise function (1) includes peripheral part covers (32, 34) configured to openably cover the insertion grooves (22, 23) for the lower exercise arms (20, 21) formed on a peripheral part of the upper surface (5) of the main frame (4) and covers and hides the insertion grooves (22, 23) when the user does not exercise, an exterior of the bed can be further neat and foreign matter can be prevented from being introduced into the insertion grooves (22, 23).

MODES OF THE INVENTION

Figure 1:
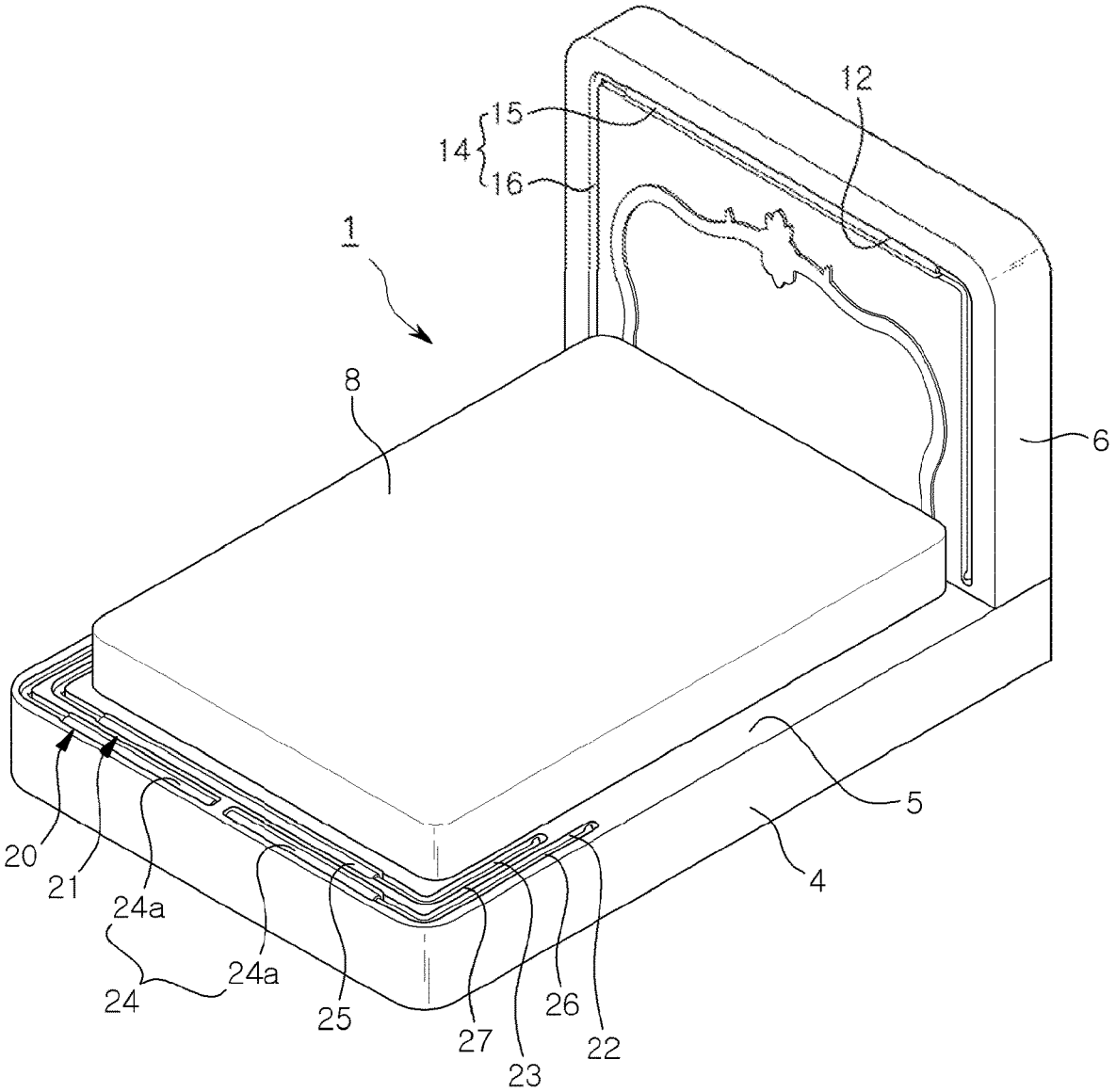
FIG. 1 is a perspective view illustrating a bed with an exercise function according to one embodiment of the present invention.
Figure 2:
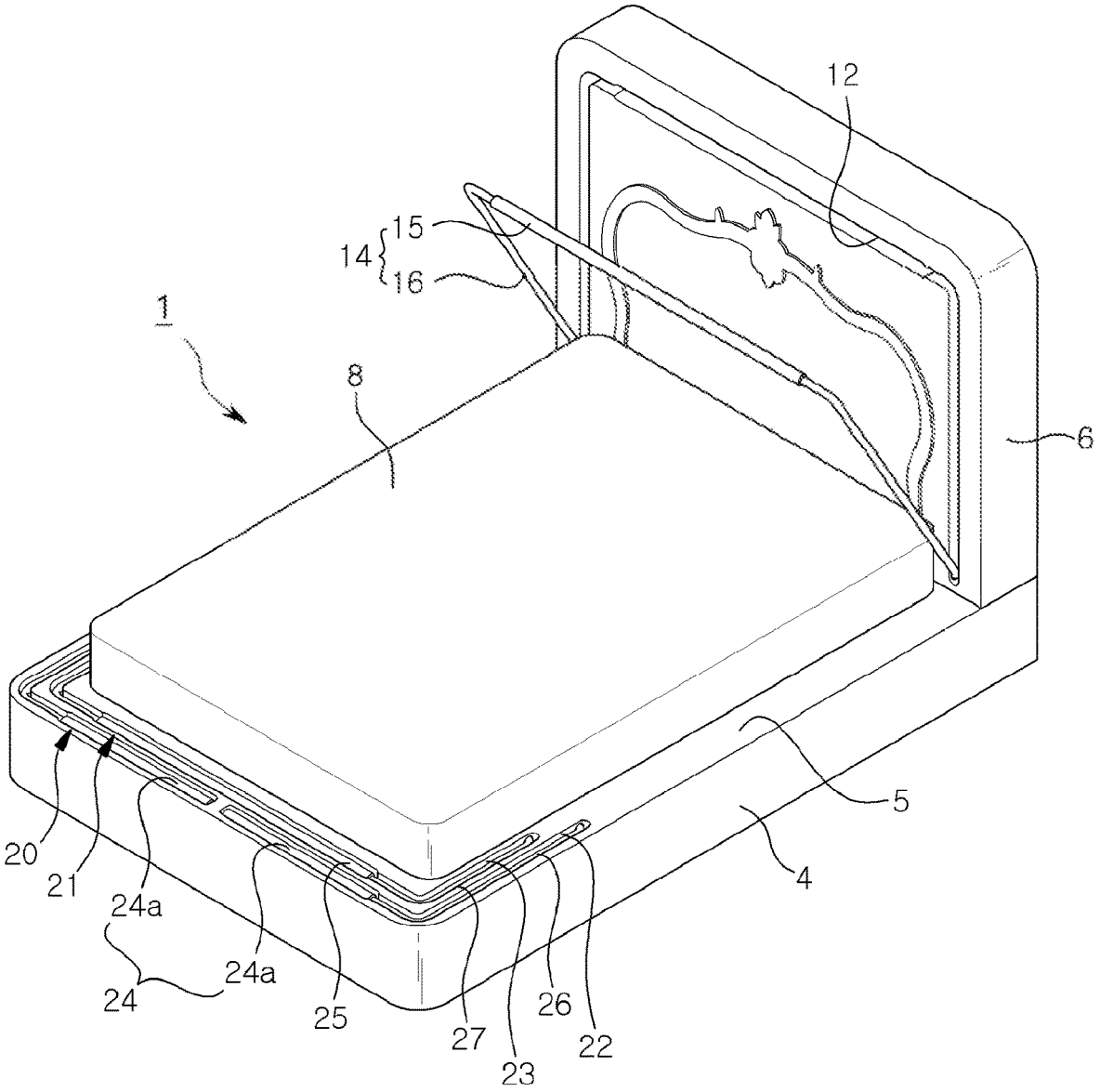
FIG. 2 is a view illustrating a state in which an upper exercise arm according to the embodiment rotates and protrudes.
Figure 3:
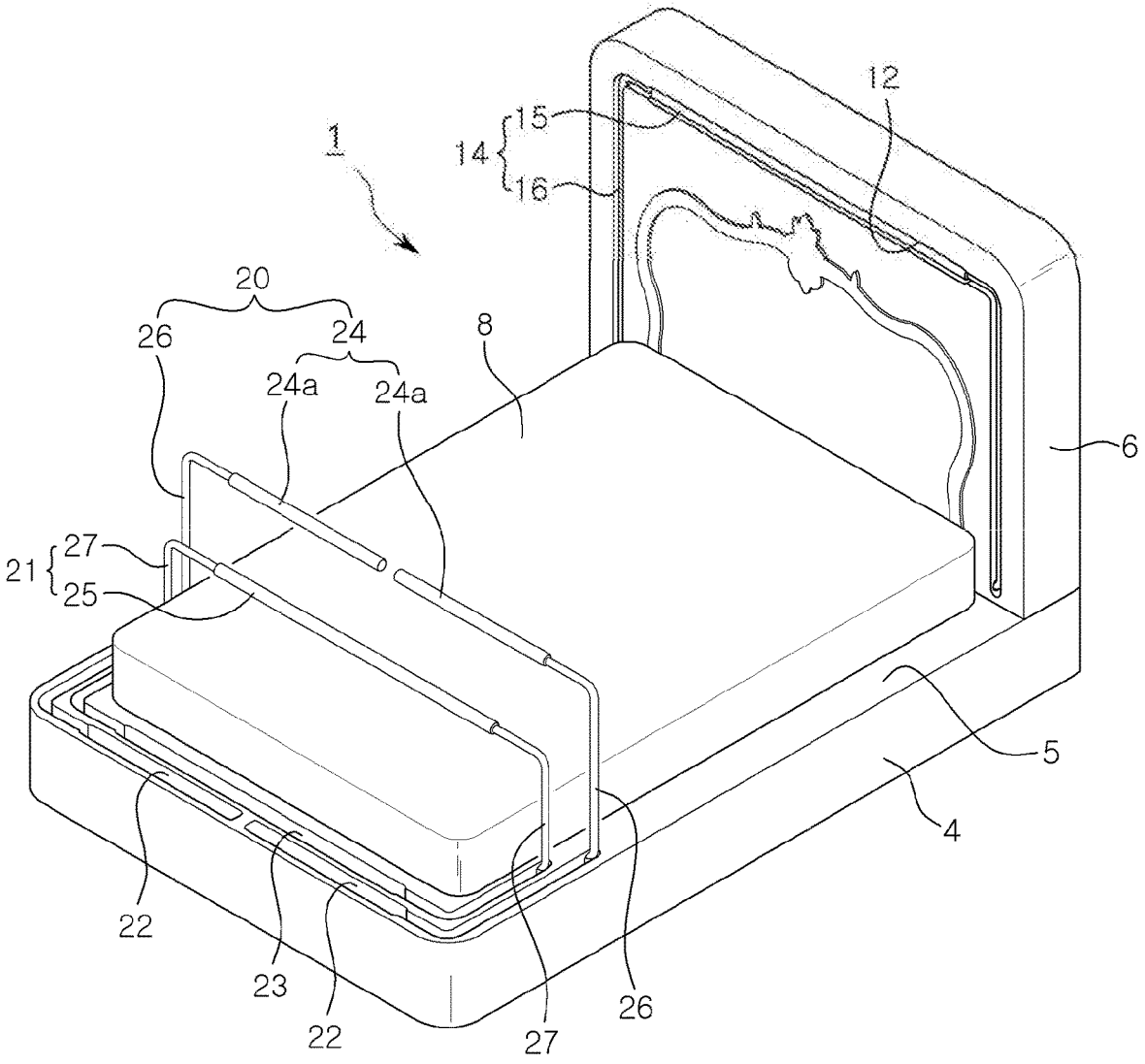
FIG. 3 is a view illustrating a state in which a lower exercise arm according to the embodiment rotates and protrudes.
Figure 4:
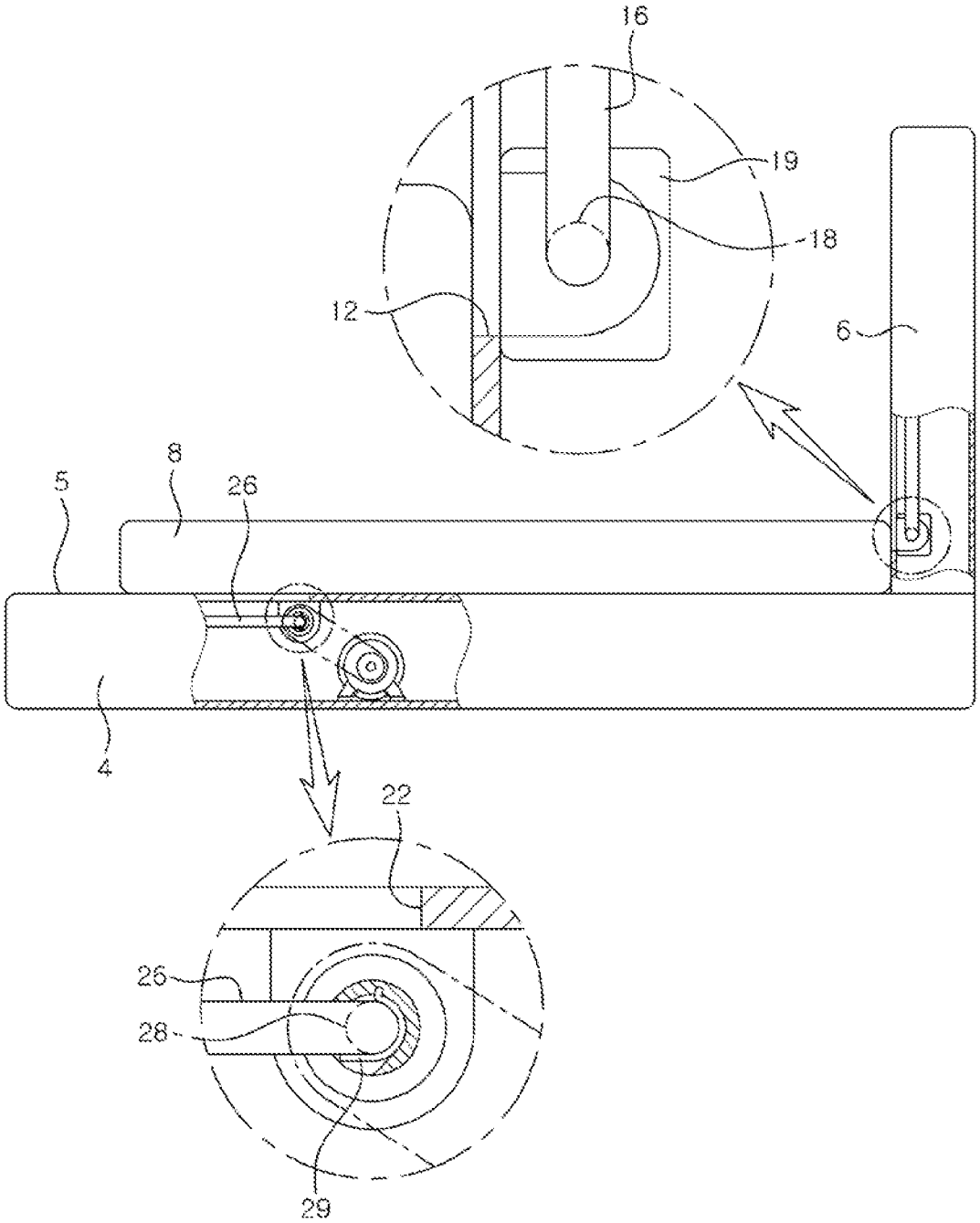
FIG. 4 is a cross-sectional view illustrating a part of the bed with an exercise function according to the embodiment.

Hereinafter, exemplary embodiments of the present invention will be described with reference to the accompanying drawings. FIG. 1 is a perspective view illustrating a bed with an exercise function according to one embodiment of the present invention, FIG. 2 is a view illustrating a state in which an upper exercise arm according to the embodiment rotates and protrudes, FIG. 3 is a view illustrating a state in which a lower exercise arm according to the embodiment rotates and protrudes, and FIG. 4 is a cross-sectional view illustrating a part of the bed with an exercise function according to the embodiment.

The bed with an exercise function bed includes a main frame 4 having an upper surface 5 on which a mattress 8 and bed linen are placed and a head part 6 standing upright at an end, which is a head side of the bed, of the main frame 4 like a conventional bed as described in the drawings. However, according to the present invention, an insertion groove 12 having a cross section in a channel shape is formed along a perimeter of a front surface of the head part 6, and an upper exercise arm 14 including a horizontal bar 15 and leg parts 16 extending downward from both ends of the horizontal bar 15 is provided in the insertion groove 12. In the illustrated embodiment, the insertion groove 12 is formed along the inner perimeter of the front surface of the head part 6, but in some cases the insertion groove 12 may also be formed along a perimeter of an edge part of the head part 6.

The upper exercise arm 14 is provided to be rotated forward so as to protrude from the insertion groove 12 by a rotary support part 18 such as a rotating shaft provided at a lower end of the leg part 16 and embedded in the main frame 4 or the head part 6. The rotary support part 18 may be preferably formed as the rotating shaft, but may have a suitable structure which is capable of rotatably supporting the upper exercise arm 14 and may have a shape different from that of the rotating shaft.

In addition, the upper exercise arm 14 includes a rotation stopping part 19 configured to stop rotation of the upper exercise arm 14 in a state in which the upper exercise arm 14 protrudes forward at a predetermined angle. In the illustrated exemplary embodiment, the rotation stopping part 19 is formed as a control motor such as a servomotor which is shaft-coupled to the rotary support part 18 which is the rotating shaft. Accordingly, when the servomotor is automatically operated by a remote controller or operation button which is not illustrated in the drawings, and the servomotor stops after the upper exercise arm 14 rotates and protrudes at the predetermined angle, the upper exercise arm 14 may stop at a position, at which the upper exercise arm 14 protrudes, due to a stopping operation of the stopped servomotor. As described above, in the case in which the upper exercise arm 14 is driven by the control motor such as the servomotor, the servomotor which is a driving unit serves as the rotation stopping part 19. Alternately, by including a separate mechanical driving unit or stopping unit and moving the upper exercise arm 14 to a predetermined position and fixing the position, the upper exercise arm 14 is configured like an exercising apparatus such as a pull-up bar to withstand a weight of a person.

Meanwhile, according to the present invention, insertion grooves 22 and 23 are formed along an edge part of the upper surface 5 which is at a leg side which faces the head part 6 of the main frame 4. Preferably, the two insertion grooves 22 and 23, which are big and small, are formed to be adjacent to and overlap each other. In addition, in the insertion grooves 22 and 23, lower exercise arms 20 and 21 respectively including horizontal bars 24 and 25 and leg parts 26 and 27 perpendicularly extending from both ends of the horizontal bars 24 and 25 are further provided. A rotary support part 28 configured to rotatably support the lower exercise arms 20 and 21 is included at lower ends of the leg parts 26 and 27. The rotary support part 28 is preferably formed as a rotating shaft, but may also be formed as another unit capable of rotatably supporting the lower exercise arms 20 and 21. In addition, the lower exercise arms 20 and 21 may also be automatically moved upward to protrude or moved downward to be accommodated by a control motor such as a servomotor. Since the lower exercise arms 20 and 21 may be rotated upward and vertically stopped such that a user performs a leg exercise while pushing the lower exercise arms 20 and 21 with feet, or a sit-up while hooking the feet on the lower exercise arms 20 and 21, or performs an exercise such as a pushup while turning over in the bed and gripping the lower exercise arms 20 and 21, the lower exercise arms 20 and 21 are convenient.

In addition, according to the present invention, at least one of the plurality of lower exercise arms 20 and 21 is formed such that the horizontal bar 24 is laterally divided into a pair of horizontal bars 24*a* and the leg parts 26 of the horizontal bars 24*a* include separate elastic support units 29. Accordingly, in the case of a bed such as a double bed used by a couple, since the man and woman who have different exercise abilities can perform exercises individually while pushing the divided horizontal bars 24*a* with feet or pushing or pulling the divided horizontal bars 24*a* with hands, the couple can use the bed according to the individual exercise abilities, and thus the bed is convenient.

Figure 5:
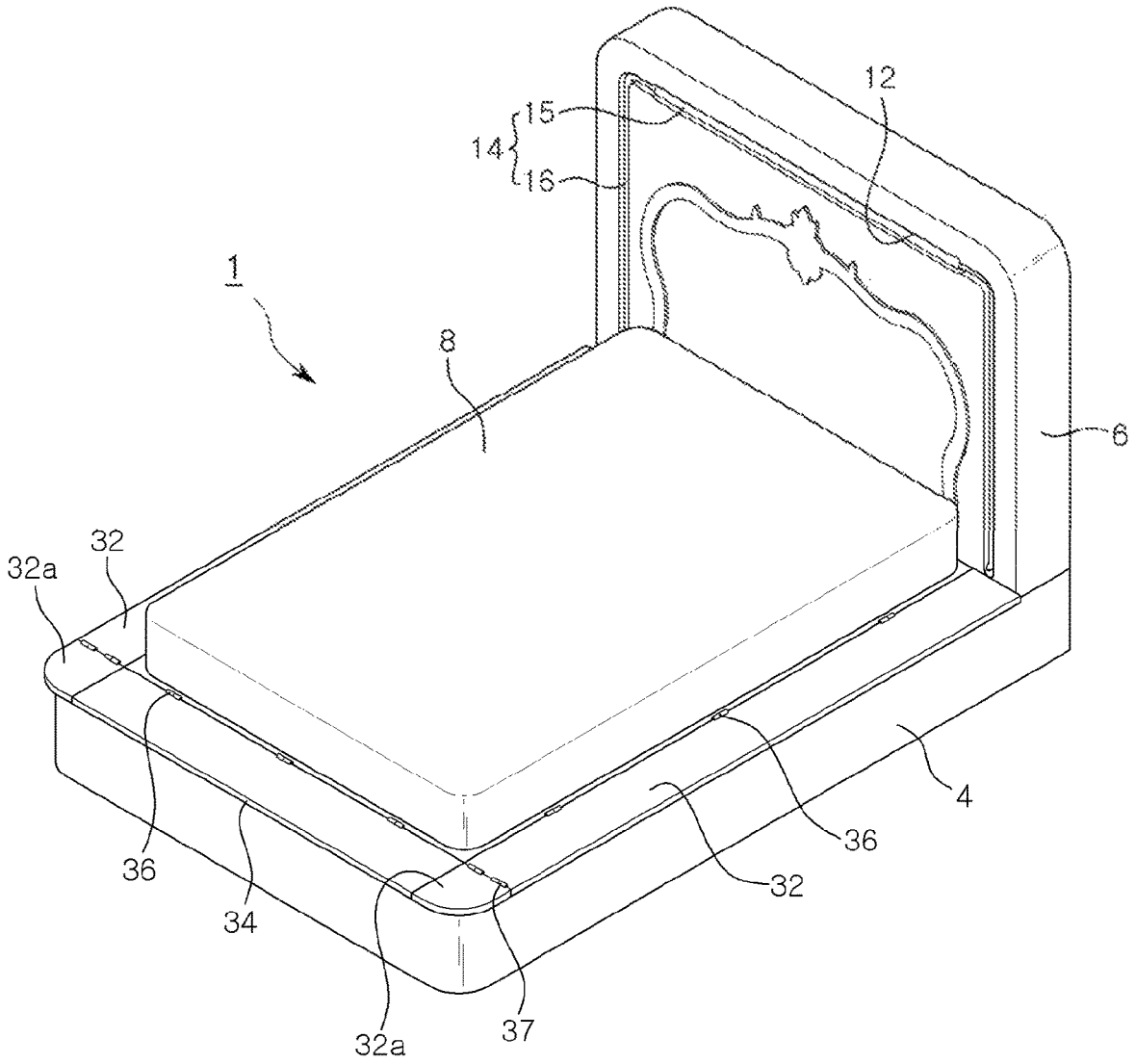
FIGS. 5 and 6 are configuration views illustrating a bed with an exercise function according to another embodiment of the present invention.
Figure 6:
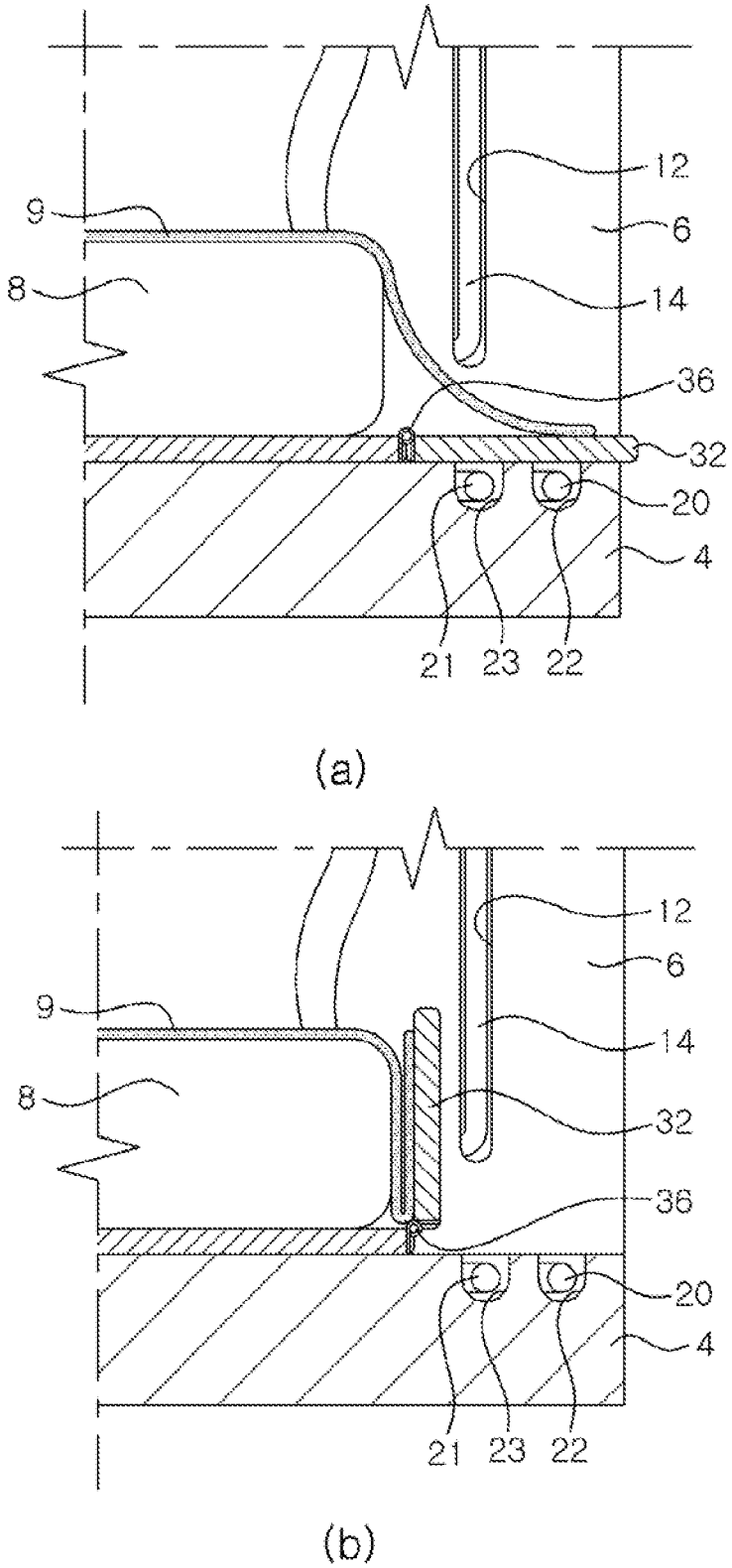

FIGS. 5 and 6 are configuration views illustrating a bed with an exercise function according to another embodiment of the present invention. As illustrated in the drawings, peripheral part covers 32 and 34 configured to openably cover insertion grooves 22 and 23 for lower exercise arms 20 and 21 are provided in a peripheral part of an upper surface 5 of a main frame 4. The peripheral part covers 32 and 34 include a pair of side peripheral part covers 32 and a single end peripheral part cover 34. Preferably, outer ends of the peripheral part covers 32 and 34 are rotated and opened by hinges 36 disposed inside the peripheral part covers 32 and 34.

In a case in which bed linen 9 such as a bed cover or blanket is placed on an outer peripheral part outside the mattress 8, when the outer ends of the peripheral part covers 32 and 34 are rotated upward and opened by the inner hinges 36 as described above, the peripheral part covers 32 and 34 are moved upward with the bed cover, blanket, and the like when being opened, and thus the lower exercise arms 20 and 21 may be easily rotated and moved upward without being hooked on the bed cover and the like and become an exercise-enabling state, or the lower exercise arms 20 and 21 may be rotated and moved downward without being interfered with the bed cover and the like, and thus the lower exercise arms 20 and 21 may be accommodated in the insertion grooves 22 and 23.

In the illustrated embodiment, a front end of the side peripheral part cover 32, that is, a part adjacent to the end peripheral part cover 34 is manufactured so as to be divided into a corner cover 32*a* so as to be folded by hinges 37. This is for not interfering with the rotating lower exercise arms 20 and 21 in a state in which the peripheral part cover 32 is rotated and opened.

Figure 7:
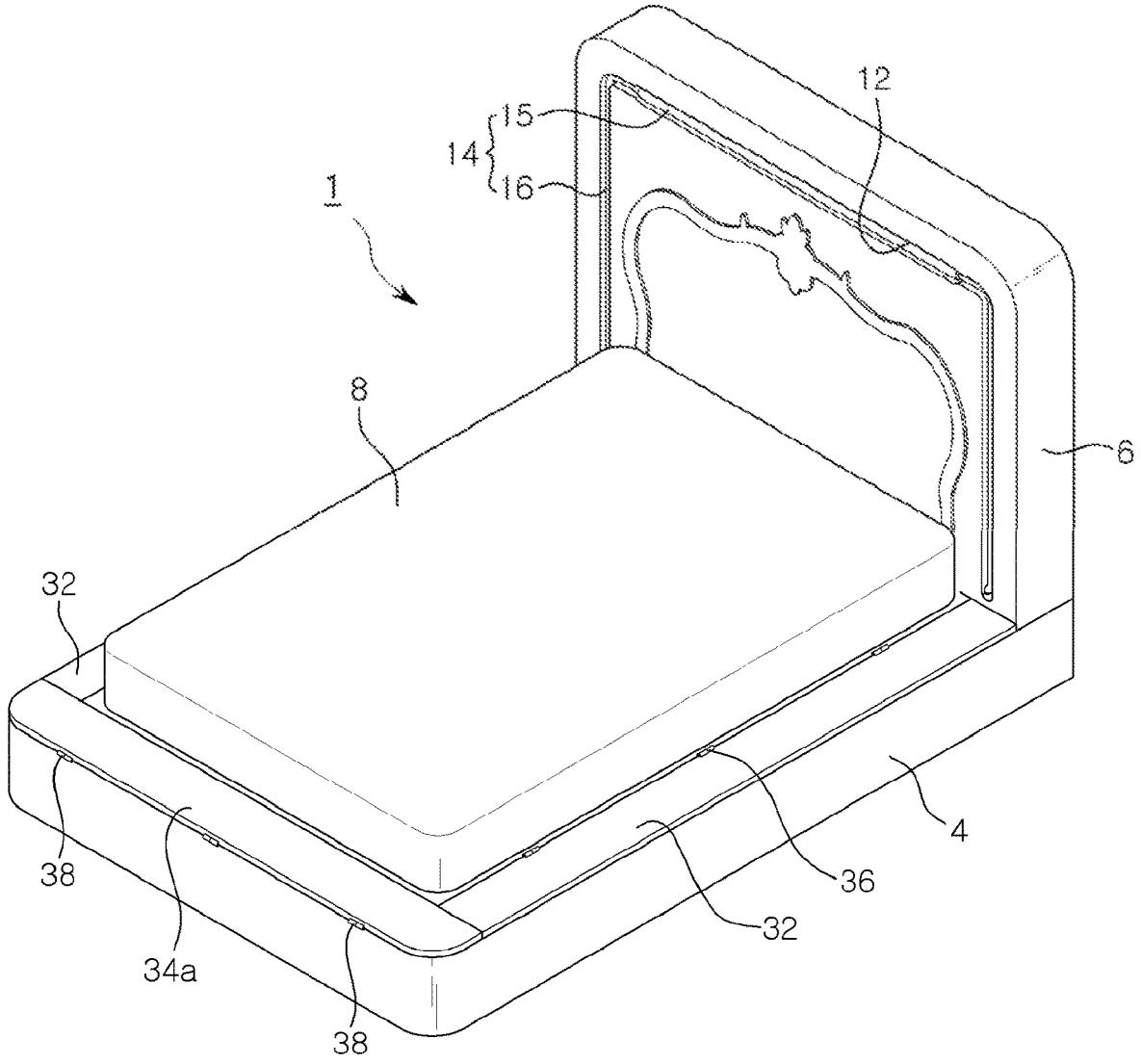
FIGS. 7 and 8 are configuration views illustrating a bed with an exercise function according to still another embodiment of the present invention.
Figure 8:
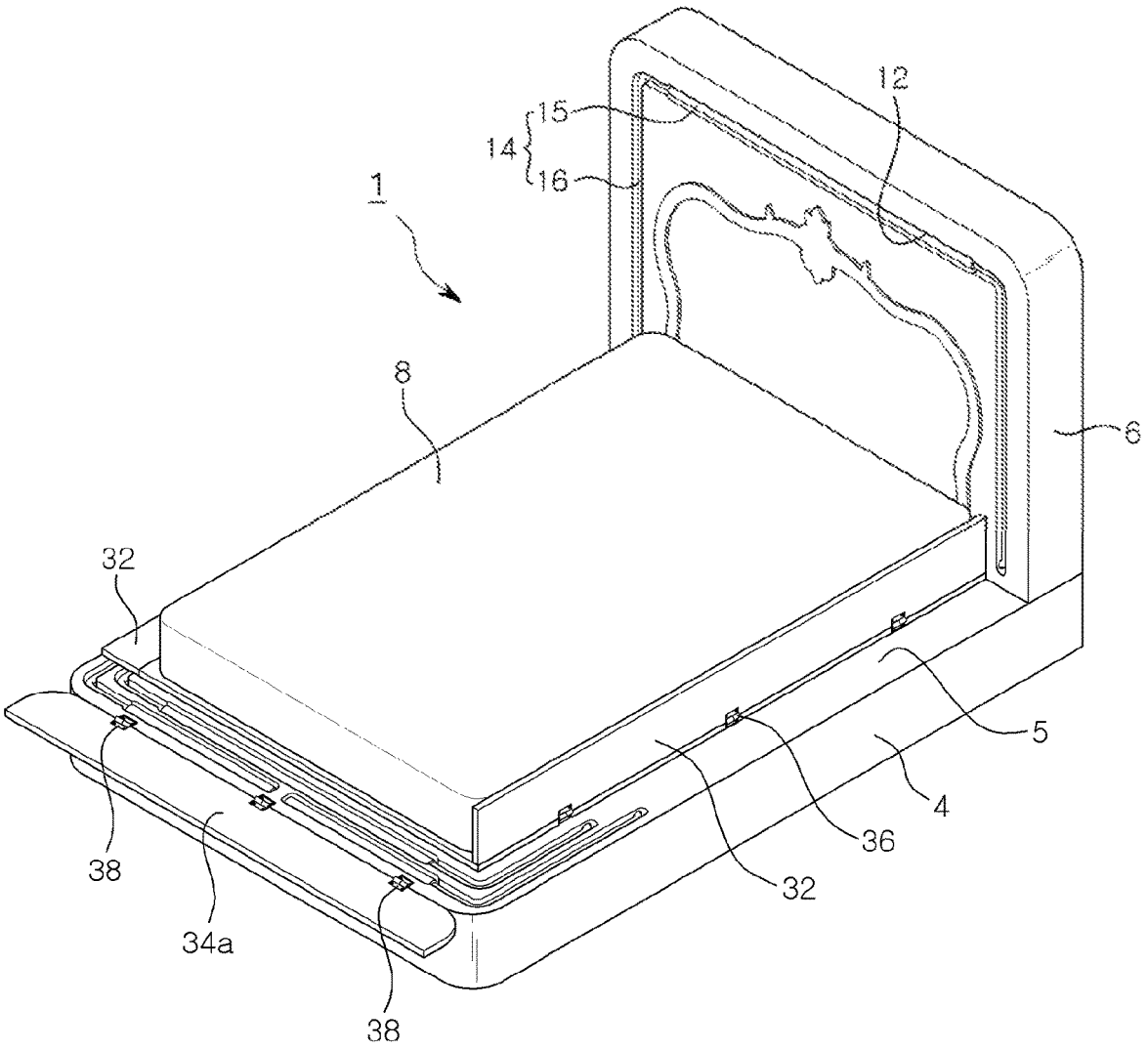

FIGS. 7 and 8 are configuration views illustrating a bed with an exercise function according to still another embodiment of the present invention. Unlike the above-described embodiment, an end peripheral part cover 34*a* extends over an entire width of a main frame 4, hinges 38 of the end peripheral part cover 34*a* are disposed on an outer side of an upper surface 5 of the main frame 4, and the end peripheral part cover 34*a* is rotated outward and moved upward. According to such a structure, even when the end peripheral part cover 34*a* extends over the entire width of the main frame 4, since the end peripheral part cover 34*a* does not interfere with lower exercise arms 20 and 21 rotated in a state in which the end peripheral part cover 34*a* is opened, a corner cover 32*a* which is the same as that of the above-described embodiment is not necessary at an end of the end peripheral part cover 34*a*, and thus a bed has a simple structure and is easy to manufacture.

The invention claimed is:

1. A bed with an exercise function which includes a main frame formed with an upper surface on which a mattress and bed linen are placed, and a head part which stands upright at one end of the main frame, the bed with an exercise function comprising:

an upper exercise arm which is embedded in an insertion groove formed in a front surface or peripheral part of the head part, has a horizontal bar and leg parts extending downward from both ends of the horizontal bar, and is rotatable to protrude forward by a rotary support part provided at a lower end of the leg part; and a rotation stopping part which is coupled to the upper exercise arm and stops rotation of the upper exercise arm in a state in which the upper exercise arm protrudes forward at a predetermined angle, wherein the insertion groove includes a horizontal groove part and vertical groove parts, the horizontal groove part being formed in a horizontal direction in the front surface of the head part to accommodate the horizontal bar, the vertical groove parts being formed in a vertical direction in the front surface of the head part to accommodate the leg parts respectively and extending downward from both ends of the horizontal groove part, wherein the rotary support part and the rotation stopping part are combined with the lower end of the leg part at each lower portion of the vertical groove parts, wherein the upper exercise arm is configured to rotate at each lower portion of the vertical groove parts with the rotation support part as a rotation axis.

2. The bed of claim 1, further comprising lower exercise arms which are embedded in insertion grooves formed along a peripheral part of the upper surface which is at a leg side of the bed with an exercise function that faces the head part of the main frame, have horizontal bars and leg parts perpendicularly extending from both ends of the horizontal bars, and are rotatable to protrude upward by rotary support parts 24 provided at both ends of the leg parts.

3. The bed of claim 2, wherein at least one of the lower exercise arms is constituted as a pair of divided horizontal bars into which the horizontal bar is laterally divided, and an elastic support unit is provided at each of the leg parts of the divided horizontal bars and are individually and elastically rotatable by an external force.

4. The bed of claim 2, wherein the peripheral part of the upper surface of the main frame includes peripheral part covers configured to openably cover the insertion grooves for the lower exercise arms.

5. The bed of claim 3, wherein the peripheral part of the upper surface of the main frame includes peripheral part covers configured to openably cover the insertion grooves for the lower exercise arms.

* * * * *